United States Patent [19]

Wigger

[11] 4,375,135

[45] Mar. 1, 1983

[54] APPARATUS AND METHOD FOR SIGNALING UNSAFE HANDLING AND OPTIMUM FIRING OF A SHOULDER WEAPON

[76] Inventor: Lawrence H. Wigger, 6750 S. 73rd E. Ave., Tulsa, Okla. 74133

[21] Appl. No.: 240,276

[22] Filed: Mar. 4, 1981

[51] Int. Cl.[3] ..... F41C 27/00

[52] U.S. Cl. ..... 42/1 A

[58] Field of Search ..... 42/1 A, 70 G, 70 R; 116/4, 200, 201, 137 R; 434/11, 19

[56] References Cited

U.S. PATENT DOCUMENTS

| | | | |
|---|---|---|---|
| 1,098,612 | 6/1914 | Bourdelles | 42/70 G |
| 2,134,406 | 10/1938 | Jacobs | 42/1 A |
| 2,325,599 | 8/1943 | Fidelman | 42/1 A |
| 3,044,204 | 7/1962 | Zimmerman | 42/1 A |
| 4,007,553 | 2/1977 | Clegg | 42/1 A |

*Primary Examiner*—Charles T. Jordan

*Attorney, Agent, or Firm*—John Wade Carpenter

[57] ABSTRACT

An apparatus and method of signaling unsafe handling and optimum firing of a shoulder weapon by monitoring the attitude of the weapon. The method includes attaching to the weapon the apparatus which intermittently emits an audible signal when the weapon reaches a predetermined angular position with respect to a horizontal plane; moving the weapon to at least the predetermined angular position in order to activate the audible signal; and determining whether or not the moving step was intentional or unintentional. The apparatus comprises a power source; an audio oscillator electrically engaging and responsive to the power source for activating an audio signal; an audio transducer electrically connected to the audio oscillator for converting an audio signal into an acoustical signal; an electronic switch electrically attached to the audio oscillator and to the power source for switching the oscillator "on" and "off"; and a mercury switch electrically connected to the power source and to the electronic switch for closing and opening the circuitry of the apparatus.

22 Claims, 11 Drawing Figures

APPARATUS AND METHOD FOR SIGNALING UNSAFE HANDLING AND OPTIMUM FIRING OF A SHOULDER WEAPON

BACKGROUND OF THE INVENTION

1. Field of the Invention

This invention provides an apparatus and process for signaling unsafe handling and optimum firing of a shoulder weapon by monitoring the attitude of the weapon. More specifically, this invention contemplates a cylindrical apparatus and process for signaling unsafe handling and optimum firing of a shoulder weapon by intermittently emitting an audio signal when the barrel of the weapon reaches a predetermined angular position with respect to a horizontal plane.

2. Description of the Prior Art

No prior art teaches or suggests an apparatus and process which in combination not only signals unsafe handling of a shoulder weapon, but also signals for optimum firing of the weapon, by monitoring the attitude of the weapon. U. S. Pat. No. 2,600,363 by Morris relates to the audible leveling means for cameras or other devices wherein the same includes either visual or audible signal means that will indicate that the camera or device on which the unit is mounted is tilted more than a certain degree in a given direction. U.S. Pat. No. 2,979,845 by Christiansen Jr. teaches an automatic safety system wherein the trigger of a firearm cannot be activated until the firearm is in the proper position for discharging. U.S. Pat. No. 3,044,204 by Zimmerman discloses a signal light system for a firearm which indicates when the usual safety mechanism of the weapon is in the off or firing position. U.S. Pat. No. 3,601,729 by Hierta discloses a switch assembly which may be mounted on any device or apparatus to be activated when the device or apparatus on which the same is mounted is tilted or changed in position beyond a predetermined amount. U.S. Pat. No. 4,189,726 by Rosa, et al. teaches a leveling signal used in combination with a tool whereby when the tool is disposed in a position other than horizontal, a signal indicates that the drill is not in a horizontal or vertical plane. Therefore, what is needed and what has been invented by me is an apparatus and process which doesn't include the deficiencies of the foregoing prior art and signals not only unsafe handling of a shoulder weapon, but also signals when the weapon is optimumly ready to fire at game, or the like, by monitoring the attitude of the barrel of the weapon.

SUMMARY OF THE INVENTION

This invention accomplishes its desired objects by providing an appratus and process of signaling unsafe handling and optimum firing of a shoulder weapon by monitoring the attitude of the weapon. The process includes attaching to the weapon a means for intermittently emitting an audible signal when the weapon reaches a predetermined angular position with respect to a horizontal plane; moving the weapon to at least the predetermined angular position to activate the audible signal; and determining whether or not the moving step was intentional in order for continuing to move the weapon to a shooting posture with respect to a hunter or unintentional indicating that the weapon is being handled unsafely and should be moved from the predetermined angular position. The apparatus comprises a power source means; an audio oscillator means electrically engaging and responsive to the power source means for creating an audio signal; an audio transducer means electrically connected to the audio oscillator means for converting an audio signal into an acoustical signal; electronic switch means electrically attached to the audio oscillator means and to the power source means for switching the oscillator "on " and "off"; and a switch means electrically connected to the power source means and to the electronic switch means for closing and opening the circuitry of the apparatus.

It is an object of the invention to provide an apparatus and process for signaling unsafe handling of a shoulder weapon. It is another object of the invention to provide an apparatus and process of signaling optimum firing of a shoulder weapon.

It is yet another object of the invention to provide an apparatus and process which can in combination signal the unsafe handling and the optimum firing by monitoring the attitude of the barrel of the weapon.

Still further objects of the invention reside in the provision of an apparatus for signaling unsafe handling and optimum firing of a shoulder weapon by monitoring the attitude of the weapon which is relatively inexpensive to manufacture, can be easily transported and connected to the barrel of the weapon.

These together with the various ancillary objects and features will become apparent as the following description proceeds, are attained by this invention, preferred embodiments being shown in the accompanying drawings, by way of example only, wherein:

DETAILED DESCRIPTION OF THE INVENTION

Figure 1:
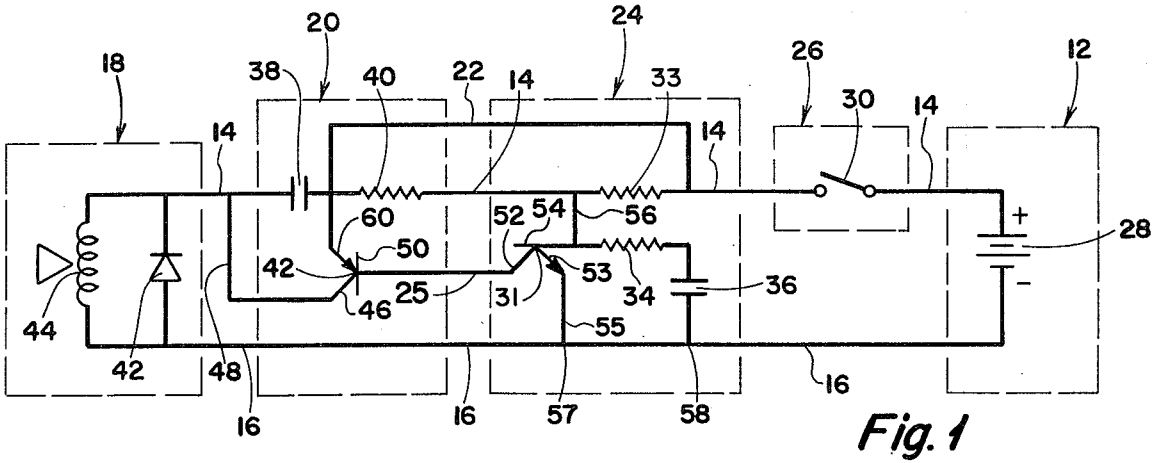
FIG. 1 is a circuitry diagram of the invention.

Referring in detail now to the drawings wherein similar parts of the invention are identified by like reference numerals, there is seen an apparatus, generally illustrated as 10, having a speaker end 7 and enclosed end 9 and attached by a clamp 11 to a barrel 13 of a shoulder weapon 15 for intermittently emitting an audible signal. The circuitry for the apparatus 10 (see FIG. 1) comprises a power source means, generally illustrated as 12, having a positive conductor 14 and a negative conductor 16 electrically attached to an audio transducer means, generally illustrated as 18, for converting an audio signal into an acoustical signal. An audio oscillator means, generally illustrated as 20, electrically engages transducer means 18 via conductor 14 for creating an audio signal in response to the power source means 12. Audio oscillator means 20 is also electrically attached to an electronic switch means, generally illustrated as 24, via conductors 22, 25, and positive conductor 14. Electronic switch means 24 switches the oscillator means 20 "on" and "off", and is electrically connected to the power source means 12 by the positive conductor 14 and the negative conductor 16. A switch means, generally illustrated as 26, electrically attaches on conductor 14 to the power source means 12 for closing and opening the circuitry of the apparatus 10.

In a preferred embodiment of the invention, power source means 12 is a D. C. battery 28, and switch means 26 is a cylindrical mercury switch 30 having mercury 32 flowably disposed therein. Electronic switch means 24 preferably includes a transistor 31, resistors 33 and 34, and a capacitor 36. Oscillator means 20 comprises a transistor 42 and a capacitor 38 electrically connected in series with a resistor 40 on positive conductor 14. Audio transducer means 18 includes a diode 42 connecting across positive conductor 14 and negative conductor 16, and a speaker 44. Electronic switch means 24 comprises resistors 33 and 34, transistor 31 and a capacitor 36.

Resistor 33 is attached in series on positive conductor 14 between switch 30 and resistor 40. The collector electrode 46 of transistor 42 connects to positive conductor 14 via a conductor 48 at a point between the capacitor 38 and the connecting point of diode 42 to the positive conductor 14. The base 50 of transistor 42 is connected to the collector electrode 52 of transistor 31 by conductor 25. The emitter electrode 53 of transistor 31 attaches to the negative conductor 16 by conductor 55 at a connecting point 57. The base 54 of transistor 31 connects to the positive conductor 14 through conductor 56 at a point between resistor 33 and resistor 40. Resistor 34 and capacitor 36 are connected in series, in order stated, from the base 54 of transistor 31 to a connecting point 58 on the negative conductor 16. Connecting point 58 on negative conductor 16 is positioned between the negative terminal of the battery 28 and the connecting point 57. Point 57 is placed between the connecting position of diode 42 to the negative conductor 16 and the connecting point 58. The emitter electrode 60 of transistor 42 electrically attaches through conductor 22 to the positive conductor 14 at a point between resistor 33 and switch 30. The discrete components (transistor 42, capacitor 38 and transistor 40) of oscillator means 20 may be combined into an integrated circuitry on one single monolithic chip. Likewise, the discrete components (transistor 31, capacitor 36, and resistors 33 and 34) of electronic switch means 24 may also be combined on one single monolithic chip; and oscillator means 20 and electronic switch means 24 may be combined into an integrated circuitry on one single monolithic chip. Monolithic chips are well known to those in the art.

Figure 4:
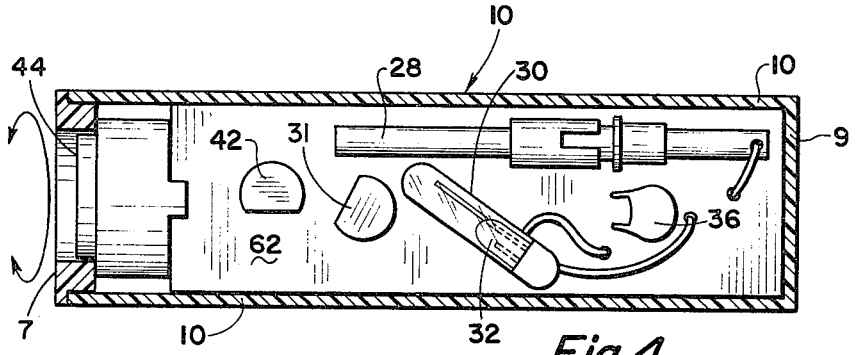
FIG. 4 is an enlarged sectional view of the cylindrical housing disclosing a side of the circuitry board with some of the electrical components of FIG. 1.
Figure 5:
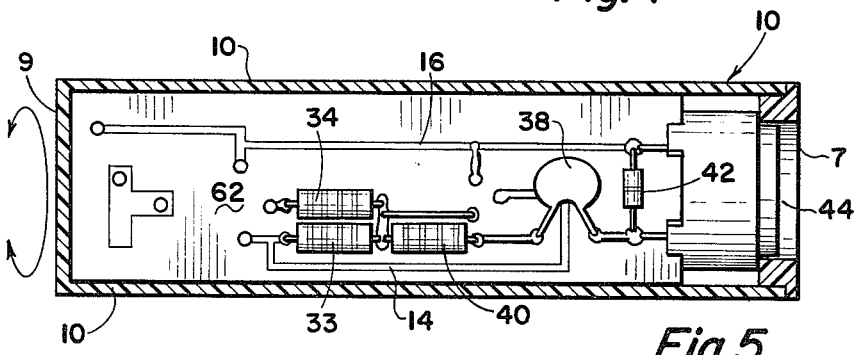
FIG. 5 is an enlarged sectinal view of the cylindrical housing disclosing the opposite side of the circuitry board having the remaining electrical components of FIG. 1.
Figure 6:
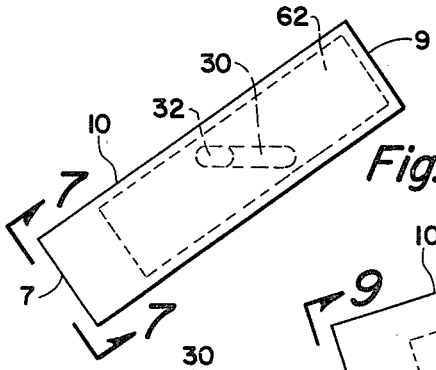
FIG. 6 is a planar view of the cylindrical housing disclosing the circuitry board and mercury switch as dotted lines with the mercury switch open and at a predetermined angular position with respect to the grid or a horizontal plane.
Figure 7:
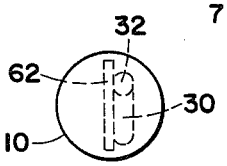
FIG. 7 is a vertical view taken in direction of the arrows along the plane of line 7—7 in FIG. 6.
Figure 8:
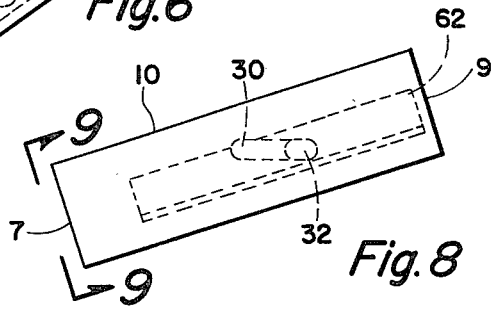
FIG. 8 is another planar view of the cylindrical housing disclosing the circuitry board and mercury switch as dotted lines with the mercury switch closed and at another predetermined angular position with respect to the grid or a horizontal plane.
Figure 9:
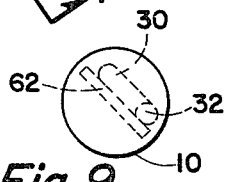
FIG. 9 is a vertical view taken in direction of the arrows along the plane of line 9—9 in FIG. 8.

The foregoing circuitry is placed on a circuitry board 62 and is encapsulated within the cylindrical apparatus 10 which includes a longitudinal axis. As can be seen in FIGS. 4, 6–11, mercury switch 30 is obliquely displaced with respect to the longitudinal axis. Apparatus 10 does not have to be cylindrical, but in a preferred embodiment it is cylindrical in order to be rotated within clamp 11 to adjust at what predetermined angle (with respect to a horizontal plane) the mercury 32 will flow from one end of the cylindrical mercury switch 30 to the other to close the circuitry, causing the emitting of the audio signal. FIGS. 4, 8 and 9 disclose the closed circuitry wheres FIGS. 6, 7, 10, and 11 show the open circuit of the circuit diagram in FIG. 1.

Figure 2:
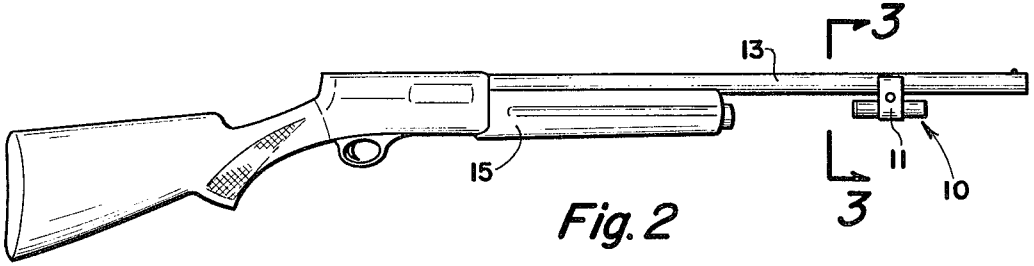
FIG. 2 is a side elevational view of a weapon having the invention clamped to the barrel thereof.
Figure 3:
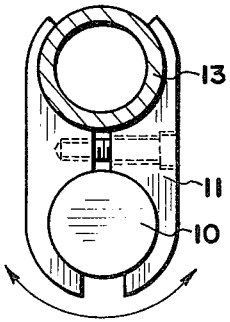
FIG. 3 is a vertical sectional view taken in direction of the arrows along the plane of line 3—3 in FIG. 2.
Figure 11:
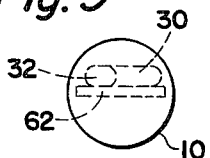
FIG. 11 is a vertical view taken in direction of the arrows along the plane of line 11—11 in FIG. 10.
Figure 10:
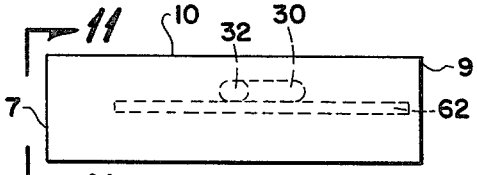
FIG. 10 is yet another planar view of the cylindrical housing disclosing the circuitry board and mercury switch as dotted lines with the mercury switch open and at yet another predetermined angular position with respect to the grid of a horizontal plane.

Rotating the apparatus 10 (see FIGS. 6–11) either clockwise or counterclockwise about its longitudinal axis changes height differential of the ends of switch 30 with respect to a horizontal plane cutting the imaginery point of center of gravity of the mercury switch 30 on the longitudinal axis of the switch 30 and at approximately mid-point between the two ends thereof. The smaller the height differential between the two ends of the obliquely disposed switch 30, the less tilt needed on end 9 of the apparatus 10 to cause the mercury 32 of flow down towards the other end of the cylindrical mercury switch 30. FIGS. 10 and 11 disclose essentially no height differential with respect to a horizontal plane between the two ends of the switch 30; as the apparatus 10 is rotated clockwise (or as end 9 is tilted downwardly with respect to the width-wise axis thereof), the mercury 32 commences to flow down towards the other end of the switch 30 to close the circuitry and commence the intermittent audio signal. FIGS. 6, 7, 8 and 9 disclose a larger height differential between the two ends of the mercury switch 30 than that represented on FIGS. 10 and 11; a greater downward tilt of end 9 or upward tilt of end 7 (about or with respect to the width-wise axis in FIGS. 10 and 11) is needed to cause the mercury 32 to flow. Thus, the cylindrical apparatus 10 is positioned within clamp 11 such that its longitudinal axis is generally parallel to the longitudinal axis of the barrel 13 of the shoulder weapon 15, and such that as long as the barrel 13 of the weapon 15 is pointed either above or below the general horizontal position (as represented in FIG. 2), depending on which end, 7 or 9, of apparatus 10 is pointed towards the open bore of the barrel 13, no audible signal is emitted, and the apparatus 10 becomes capable of sensing the attitude of the barrel 13. And when the barrel 13 is lowered or raised to or below the general horizontal plane, the intermittent emitting of an audible commences indicating that unsafe handling of the shoulder weapon 15 is taking place. The emitting frequency of the intermittent signal emanating from the speaker 44 may be altered by changing the values of some or all of the discrete components (or changing the integrated circuitry of monolithic chip replacing the components) of the electronic switch means 24 which switches the oscillator means 20 "on" and "off". For example, changing the value of resistor 33 and/or increasing (or decreasing) the value of the capacitor 36 will alter the "on" and "off" frequency of switch means 24.

The values of the electrical components of the circuitry in FIG. 1 may be any value which accomplishes the desired objects of the invention; however, in a preferred embodiment of the invention the values of the discrete components in FIG. 1 are as follows:

Battery 28: 3 volt (BR 425)
Resistor 33: 1 Megaohm
Resistor 36: 6.8 Kohm
Resistor 40: 6.8 Kohm
Capacitor 36: 10μ
Capacitor 38: 0.01μ
Transistor 31: 3124 NPN
Transistor 42: 3114 PNP
Diode 42: 3100

With continuing reference to the drawings for operation of the invention in signaling unsafe handling and optimum firing of the shoulder weapon 15, the apparatus 10 is rotatably lodged within clamp 11, either before or subsequent to connecting the clamp 11 to the barrel 13. The apparatus 10 is subsequently adjusted within clamp 11 by rotating it (either clockwise or counterclockwise) about its longitudinal axis such that the audible signal commences to intermittently emit at a predetermined angular position with respect to a general horizontal plane indicating that the barrel 13 of the weapon 15 is at an unsafe position. Each arcuate degree rotation about its longitudinal axis gives a different angular position with respect to a horizontal plane in which the mercury 32 in the obliquely disposed switch 30 within apparatus 10 will flow from one end of the cylindrical mercury switch 30 to the other end and close the circuitry of FIG. 1. The apparatus 10 may be used on a single or double barrel weapon 15 which is to be, in operation, safely carried with the attitude of barrel 13 towards the sky or towards the ground. In the case where the barrel 13 of the weapon 15 is normally, safely carried with the barrel 13 pointed towards the ground, the apparatus 10 is positioned with the speaker 44 pointed towards the bore end of the barrel 13 and can be adjusted such that it will not intermittently emit the audible signal when the barrel 13 is kept generally pointed towards the ground, but will emit when the barrel is elevated towards a generally horizontal position. In the other case where the barrel 13 of the weapon 15 is normally carried pointed towards the sky (either over the hunter's shoulder or across his breast), the apparatus 10 can be adjusted such that it will not intermittently emit the audible signal when the barrel 13 is kept at the safe, skyward attitude, but will emit the signal as the barrel 13 is lowered toward a general horizontal position. In either case wherein the barrel 13 is elevated or lowered to intermittently emit the audible signal, the hunter has to determine whether or not the barrel 13 of the weapon 15 was moved from its normal, safe, carrying position intentionally or unintentially. If it was unintentional, then the intermittently emitting audible signal indicates that the weapon 15 is being handled unsafely and should be moved from (the predetermining angular position with respect to a horizontal plane) the unsafe position to the safe one. If the moving of the barrel 13 of the weapon 15 was intentional, then the weapon 15 should be continued to be raised to a shooting posture with respect to the hunter.

Another feature of my invention is that I can combine this unsafe-handling-indicating feature with the feature that the intermittent audible signal can be used to approximate or estimate the range of moving targets (i.e. game, or the like) by the correlation of the average target velocity and the tone pulses. In a preferred embodiment of the invention, there are approximately two "beeps" per second from the speaker 44. This, as was previously mentioned, can be changed to any desired number of tones per second by changing the values of some or all of the discrete components of the electronic switch means 24. I have discovered that with approximately two beeps per second of tone pulses, if a hunter encounters a covey of quail, my apparatus 10 can be used to estimate a distance of approximately 45 yards after about three beeps in which the quail have flown after starting to fly; this generally positions the quail at an optimum distance to be shot by the hunter, depending on where the quail initially started to fly. Thus, if the movement of the barrel 13 of the weapon 15 was intentional, and the weapon 15 is subsequently raised to a shooting posture with respect to the hunter while the audible signal continues to be intermittently emitted, the hunter can commence shooting the game, or the like, with the weapon 15 after a predetermined number of audio signals (depending on the game and the weapon 15) has been intermittently emitted, indicating that the game, or the like, is at an optinum distance (from the hunter) to be shot with the weapon 15. This correlation of the average target velocity and the tone pulses can be accomplished by those in the hunting art who are familiar with the velocity of the game to be hunted, the performance of weapon 15, the general distance from a hunter in which game will normally begin to fly or run after being encountered by the hunter, the number of "beeps" per second of the apparatus 10, etc.

When the mercury 32 flows from one end of switch 30 to another in closing the circuitry of FIG. 1, the power source means 12 provides the electrical energy to operate the apparatus 10. The position sensor (mercury switch 30) means 26 controls the energy source by appropriately closing the circuitry at an adjustable preset position. When the power source means 12 energizes the audio oscillator means 20 via position sensor means 26, the oscillator means 22 becomes operational and produces a steady audio frequency of approximately 2000 cycles per second. The electronic switch means 24 is used to control the audio oscillator means 20 by turning it "on" and "off". This feature accomplishes the following objectives: energy is conserved in the power source means 12; the hunter's attention is directed to the unsafe weapon position; the hunter or user becomes aware of an audio ranging phenomenon that affords an opportunity to select an optimum shot pattern deployment distance, based on the time interval of the electronic switch means 24. The audio transducer meand 18 accepts the electronic audio frequency signal generated by the audio oscillator means 20 and converts the electrical signal into an acoustical signal.

The features of this invention may be used as a fishing detector, and may be expanded on a special feature basis to include status input from such operating functions as the weapon 15 safety mechanism status (i.e., to indicate a ready to fire status); a cartridge magazine status (i.e., to indicate that cartridges are in the magazine); and a firing pin status (i.e. to indicate if the firearm is cocked). Such features do not limit the incorporation of the apparatus 10 to the weapon 15, to an add-on system. It may be incorporated as an integral part of the weapon 15.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A method of signaling unsafe handling and optimum firing of a shoulder weapon by monitoring the attitude of the weapon comprising the steps of:

a. attaching to the weapon a means for intermittently emitting an audible signal when the weapon reaches a predetermined angular position with respect to a horizontal plane;

b. moving the weapon to at least the predetermined angular position activating the audible signal; and c. determining whether or not said moving step (b) was intentional in order for continuing to move the weapon to a shooting posture with respect to a hunter, or unintentional indicating that the weapon is being handled unsafely and should be moved from the predetermined angular position.

2. The method of claim 1 additionally comprises continuing, if said moving step (b) was intentional, to raise the weapon to a shooting posture with respect to the hunter while the audible signal continues to be intermittently emitted; and commencing to shoot game, or the like, with the weapon after a predetermined number of audio signals has been intermittently emitted indicating that the game, or the like, is at an optimum distance to be shot with the weapon.

3. The method of claim 2 wherein said attaching step (a) is to the barrel of the weapon in order to monitor the attitude of the barrel of same.

4. The method of claim 3 additionally comprising housing cylindrically said means for intermittently emitting an audible signal, said housing being attached to said barrel of said weapon, said means for intermittently emitting an audible signal having a longitudinal axis generally parallel to the longitudinal axis of the barrel of the weapon.

5. The method of claim 4 additionally comprising changing the predetermined angular position to another predetermined angular position by rotating the cylindrical housing about its longitudinal axis with respect to the barrel of the weapon.

6. The method of claim 5 additionally comprising changing the emitting frequency of said intermittent signal.

7. The method of claim 6 wherein said means for intermittently emitting an audible signal being cylindrically housed comprises a power source means; an audio oscillator means electrically engaging and responsive to the power source means for creating an audio signal; an audio transducer means electrically connected to the audio oscillator means for converting an audio signal into an acoustical signal; electronic switch means electrically attached to the audio oscillator means and to the power source for switching the oscillator means on and off; and a switch means electrically connected to the power source means and to the electronic switch means for closing and opening the circuitry of the apparatus.

8. The method of claim 7 wherein said switch means is obliquely displaced within said cylindrical apparatus with respect to the longitudinal axis thereof.

9. The method of claim 8 wherein said power source means includes a positive conductor and a negative conductor connecting to said audio transducer means, said transducer means comprising a speaker, and a diode electrically connecting across said positive conductor and said negative conductor.

10. The method of claim 9 wherein said audio oscillator means comprises a first capacitor in series with a first resistor on said positive conductor, and a first transistor having its collector electrode electrically attached to said positive conductor at a point between the connecting point of said diode to said positive conductor and said first capacitor.

11. The method of claim 10 wherein said audio oscillator means comprises an integrated circuit on a monolithic chip providing the same functionality as said first capacitor, said first resistor, and said first transistor.

12. The method of claim 10 wherein said electronic switch means comprises a second resistor attached in series on said positive conductor with said first resistor and said switch means, said first transistor having an emitter electrode electrically connecting to said positive conductor at a point between said second resistor and said switch means; a second transistor having its collector electrode electrically engaging the base of said first transistor, and a base electrode electrically attached to said positive conductor at a point between said second resistor and said first resistor; a third resistor in series with a second capacitor and electrically connecting from the base of the second transistor to the negative conductor, said second transistor having an emitter electrode electrically attaching to said negative conductor at a point between the connecting point of the diode to the negative conductor and the connecting point of the third resistor and second capacitor from the second transistor to the negative conductor.

13. The method of claim 12 wherein electronic switch means comprises an integrated circuit on a monolithic chip providing the same functionality as said second transistor, said second and third resistors, and said second capacitor.

14. An apparatus for signaling unsafe handling and optimum firing of a shoulder weapon by monitoring the attitude of the weapon comprising a container including a power source means; an audio oscillator means electrically engaging and responsive to the power source means for creating an audio signal; an audio transducer means electrically connected to the audio oscillator means for converting an audio signal into an acoustical signal; electronic switch means electrically attached to the audio oscillator means and to the power source for switching the oscillator means on and off; and a switch means electrically connected to the power source means and to the electronic switch means for closing and opening the circuitry of the apparatus.

15. The apparatus of claim 14 wherein said container is cylindrical and said switch means is obliquely displaced within said cylindrical apparatus with respect to the longitudinal axis thereof, said switch means being a mercury switch.

16. The apparatus of claim 15 wherein said power source means includes a positive conductor and a negative conductor connecting to said audio transducer means, said transducer means comprising a speaker and a diode electrically connecting across said positive conductor and said negative conductor.

17. The apparatus of claim 16 wherein said audio oscillator means comprises a first capacitor in series with a first resistor on said positive conductor, and a first transistor having its collector electrode electrically attached to said positive conductor at a point between the connecting point of said diode to said positive conductor and said first capacitor.

18. The apparatus of claim 17 wherein said audio oscillator means comprises an integrated circuitry of a monolithic chip providing the same functionality as said first capacitor, said first resistor, and said first transistor.

19. The apparatus of claim 17 wherein said electronic switch means comprises a second resistor attached in series on said positive conductor with said first resistor and said switch means, said first transistor having an emitter electrode electrically connecting to said positive conductor at a point between said second resistor and said switch means; a second transistor having its collector electrode electrically engaging the base of said first transistor, and a base electrode electrically attached to said positive conductor at a point between said second resistor and said first resistor; a third resistor in series with a second capacitor and electrically connecting from the base of the second transistor to the negative conductor, said second transistor having an emitter electrode electrically attaching to said negative conductor at a point between the connecting point of the diode to the negative conductor and the connecting point of the third resistor and second capacitor from the second transistor to the negative conductor.

20. The apparatus of claim 19 wherein electronic switch means comprises an integrated circuitry on a monolithic chip providing the same functionality as said second transistor, said second and third resistors, and said second capacitor.

21. The apparatus of claim 20 wherein said speaker is positioned at one end of said container and said apparatus is attached to the barrel of said shoulder weapon, said speaker-end of said container facing towards the bore of said barrel.

22. The apparatus of claim 20 wherein said speaker is positioned at one end of said container and said apparatus is attached to the barrel of said shoulder weapon, said speaker-end of said container facing oppositely from the bore of said barrel.

* * * * *